US007782266B2

(12) United States Patent
Chang et al.

(10) Patent No.: US 7,782,266 B2
(45) **Date of Patent: *Aug. 24, 2010**

(54) CIRCULARLY-POLARIZED DIELECTRIC RESONATOR ANTENNA

(75) Inventors: Tze-Hsuan Chang, Taipei (TW); Jean-Fu Kiang, Taipei (TW)

(73) Assignee: National Taiwan University, Taipei (TW)

( * ) Notice: Subject to any disclaimer, the term of this patent is extended or adjusted under 35 U.S.C. 154(b) by 314 days.

This patent is subject to a terminal disclaimer.

(21) Appl. No.: 12/013,745

(22) Filed: Jan. 14, 2008

(65) Prior Publication Data

US 2009/0153403 A1 Jun. 18, 2009

(30) Foreign Application Priority Data

Dec. 14, 2007 (TW) ..... 96147960 A

(51) Int. Cl.
*H01Q 13/00* (2006.01)

(52) U.S. Cl. ..... 343/767; 343/846; 343/700 MS

(58) Field of Classification Search ..... 343/767, 343/700 MS, 702, 846–848, 829
See application file for complete search history.

(56) References Cited

U.S. PATENT DOCUMENTS 5,940,036 A * 8/1999 Oliver et al. ..... 343/700 MS
5,952,972 A * 9/1999 Ittipiboon et al. ..... 343/700 MS
6,147,647 A * 11/2000 Tassoudji et al. ..... 343/700 MS
6,292,141 B1 * 9/2001 Lim ..... 343/700 MS
6,313,797 B1 * 11/2001 Kurita et al. ..... 343/700 MS
6,323,824 B1 * 11/2001 Heinrichs et al. ..... 343/846
6,452,565 B1 * 9/2002 Kingsley et al. ..... 343/873
6,621,381 B1 * 9/2003 Kundu et al. ..... 333/202
6,833,816 B2 * 12/2004 Hilgers ..... 343/700 MS
6,879,287 B2 * 4/2005 Popov et al. ..... 343/700 MS
6,900,764 B2 * 5/2005 Kingsley et al. ..... 343/700 MS
6,940,463 B2 * 9/2005 Ittipiboon et al. ..... 343/729
6,995,713 B2 * 2/2006 Le Bolzer et al. ..... 343/700 MS
7,009,565 B2 * 3/2006 Pidwerbetsky et al. ..... 343/700 MS
7,196,663 B2 * 3/2007 Bolzer et al. ..... 343/700 MS
7,292,204 B1 * 11/2007 Chang et al. ..... 343/909
7,443,363 B2 * 10/2008 Ying ..... 343/911 R
7,504,721 B2 * 3/2009 Chen et al. ..... 257/724
7,538,728 B1 * 5/2009 Chang et al. ..... 343/700 MS
7,541,998 B1 * 6/2009 Chang et al. ..... 343/767
2002/0154062 A1 * 10/2002 Abe et al. ..... 343/700 MS
2006/0232474 A1 * 10/2006 Fox ..... 343/700 MS
2008/0042903 A1 * 2/2008 Cheng ..... 343/700 MS

* cited by examiner

*Primary Examiner*—Douglas W Owens
*Assistant Examiner*—Jennifer F Hu
(74) *Attorney, Agent, or Firm*—Rabin & Berdo, PC

(57) ABSTRACT

The present invention relates to a circularly-polarized dielectric resonator antenna (DRA). The antenna comprises a substrate, a Wilkinson power divider, a phase shifter, a ground plane and a dielectric resonator, wherein the phase shifter is connected to the Wilkinson power divider. Besides, the dielectric resonator is disposed on the ground plane, and includes a dielectric main body and a well disposed above the substrate. Additionally, the antenna is adopted to increase the linear radiation bandwidth by utilizing the well, and transceives a circularly-polarized electromagnetic wave by utilizing the Wilkinson power divider. Consequently, the circularly-polarized dielectric resonator antenna can be applied in the fields of satellite communication, Worldwide Interoperability for Microwave Access (WiMAX), and wireless communication.

9 Claims, 7 Drawing Sheets

CIRCULARLY-POLARIZED DIELECTRIC RESONATOR ANTENNA

FIELD OF THE INVENTION

The present invention relates to an antenna, and more particularly, to a circularly-polarized dielectric resonator antenna (DRA), applied in the fields of satellite communication, Worldwide Interoperability for Microwave Access (WiMAX), and wireless communication.

BACKGROUND OF THE INVENTION

Two types of polarization of antenna are frequently used, linear polarization (LP) and circular polarization (CP). When wave of CP is used for satellite communication, it is less sensitive to Faraday rotation of polarization through ionosphere than the LP wave; hence it is applied in satellite and other wireless systems like GPS.

DRA is usually operated in a $TE_{111}$ mode, and the mode has a wide beam linearly-polarized radiation pattern with a bandwidth of approximately 5-8% and having advantages of low loss and high radiation efficiency. In a common circularly-polarized DRA, an oblique aperture can be used to excite two modes with mutually orthogonal electric fields, in order to radiate circularly-polarized wave. Alternatively, a metal sheet is adhered to the surface of the dielectric resonator of the antenna, to perturb its original electric field distribution to generate two mutually orthogonal electric fields and generate the circular polarization. Alternatively, an annular or U-shaped aperture is used to excite the circularly-polarized electromagnetic wave from the dielectric resonator, but the bandwidth having an axial ratio (AR) smaller than 3 dB is approximately 3%, which is much smaller compared with a common linearly-polarized DRA which can reach 5-8% of bandwidth. The linearly-polarized bandwidth of the DRA is mainly affected by the dielectric constant of the antenna and the shape thereof, and generally, if a material with lower dielectric constant (e.g., $\in\gamma=10$) is used, the bandwidth can be increased by about 10%.

U.S. Pat. No. 6,147,647 B1 published on Nov. 14, 2000, entitled "Circularly polarized dielectric resonator antenna" discloses a dual-band dielectric resonator antenna, comprising: a first resonator formed of a dielectric material; a first ground plane formed of a conductive material on which said first resonator is mounted; a second resonator formed of a dielectric material; a second ground plane formed of a conductive material on which said second resonator is mounted, said first and second ground planes being separated from each other by a predetermined distance; and first and second probes electrically coupled to each of said resonators spaced approximately 90° apart around the perimeter of each resonator providing first and second signals, respectively, to each resonator, wherein each of said resonators resonates in a predetermined frequency band that differs from each other.

Additionally, U.S. Pat. No. 6,995,713 B1 published on Feb. 7, 2006, entitled "Dielectric resonator wideband antenna" discloses a wideband antenna consisting of a dielectric resonator or DRA mounted on a substrate with a ground plane. The resonator is positioned at a distance x from at least one of the edges of the ground plane, x being chosen such that 0.1 toreq.x.ltoreq.Lamda . . . sub. die ½, with .lamda . . . sub. die ½ where the wavelength is defined in the dielectric resonator.

Also, U.S. Pat. No. 7,196,663 B1 published on Mar. 27, 2007, entitled "Dielectric resonator type antennas" discloses a dielectric resonator antenna comprising a block of dielectric resonator having a first face intended to be mounted on ground plane and entirely covered with a first metallic layer, wherein at least one second face perpendicular to the first face is covered with a second metallic layer contacting said metallic layer covering said first face, said second metallic layer covering said second face extending over a width less than the width of the second face and over a height less than or equal to the height of the second face, and wherein said block of dielectric resonator comprises a third face being at least partially unbounded by conductive material so as to emit radiation from said third face.

The above-mentioned DRAs, U.S. Pat. No. 6,147,647 "Circularly polarized dielectric resonator", U.S. Pat. No. 6,995,713 "Dielectric resonator wideband antenna", and U.S. Pat. No. 7,196,663 "Dielectric resonator type antennas", all related to a rectangle DRA, huge effect will be brought to the wireless communication field.

SUMMARY OF THE INVENTION

According to the prior arts mentioned above, the present invention is provided with a wideband circularly-polarized dielectric resonator antenna. The antenna comprises a substrate including a first surface and a second surface, a Wilkinson power divider and a phase shifter are formed on the first surface, a ground plane and a dielectric resonator are formed on the second surface; wherein the phase shifter formed on the first surface and having a main microstrip line, a reference microstrip line, a first microstrip line, and a second microstrip line, in which input ports of the main microstrip line and the reference microstrip line are respectively connected to two output ports of the Wilkinson power divider, and the first microstrip line and the second microstrip line are respectively connected to output ports of the main microstrip line and the reference microstrip line; a ground plane formed on the second surface and having a first hollow portion and a second hollow portion; and a dielectric resonator disposed above the ground plane, which includes a dielectric main body and a well carved off the main body.

The antenna further includes a signal input/output device disposed on a side edge of the substrate. The Wilkinson power divider includes two output ports respectively connected to the input ports of the main microstrip line and the reference microstrip line of the phase shifter. The Wilkinson power divider and the phase shifter are combined such that the circularly-polarized DRA generates two $TE_{111}$ modes with the same magnitude and a phase difference of 90° when feeding a signal. The disposed positions of the first microstrip line and the second microstrip line of the phase shifter are respectively extended to correspondingly pass through centers of the first hollow portion and the second hollow portion of the ground plane. The ground plane is made of a conductive material, for example, copper, in which axis lines of the first hollow portion and the second hollow portion are mutually orthogonal. The dielectric resonator is disposed on the ground plane, and correspondingly above the first hollow portion and the second hollow portion, in which the dielectric main body has a square cross section, the well is a square or a rectangle structure, and the dielectric constant of the dielectric resonator is between 10 and 100.

To sum up, there is a rectangular well embedded into the main body of the rectilinear dielectric resonator in the present invention, and the resonator is formed to cause a discontinuity such that the electric field in the well is enhanced, to improve the radiation efficiency and reduce the quality factor, thereby increasing the bandwidth. The Wilkinson power divider and the phase shifter are joined to generate two signals with the same magnitude and a phase difference of 90°. Through a coupling aperture, signals are fed into the dielectric resonator to generate the circularly-polarized characteristics.

BRIEF DESCRIPTIONS OF THE DRAWINGS

The foregoing aspects, as well as many of the attendant advantages and features of this invention will become more apparent by reference to the following detailed description, when taken in conjunction with the accompanying drawings, wherein.

DESCRIPTION OF EMBODIMENTS

Figure 1:
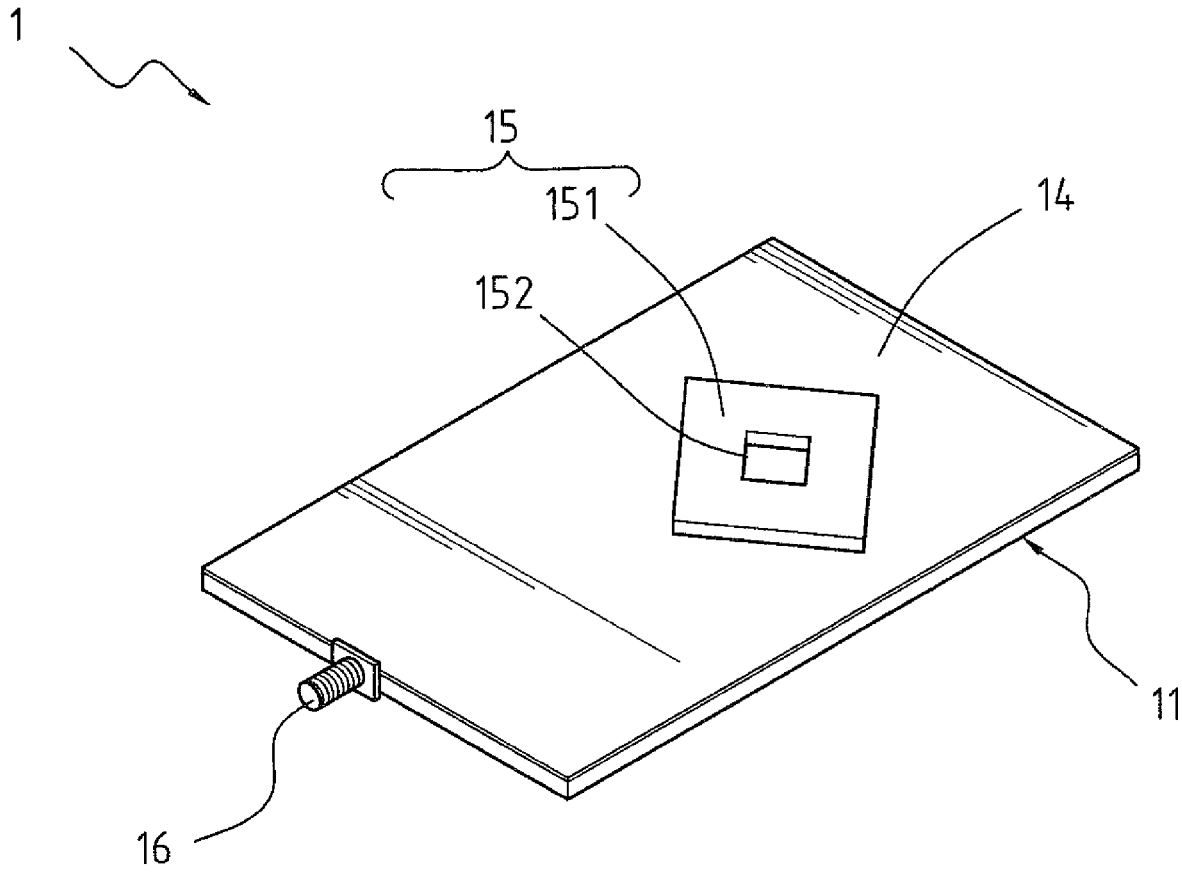
FIG. 1 is a perspective diagram of the circularly-polarized DRA of the present invention.
Figure 2:
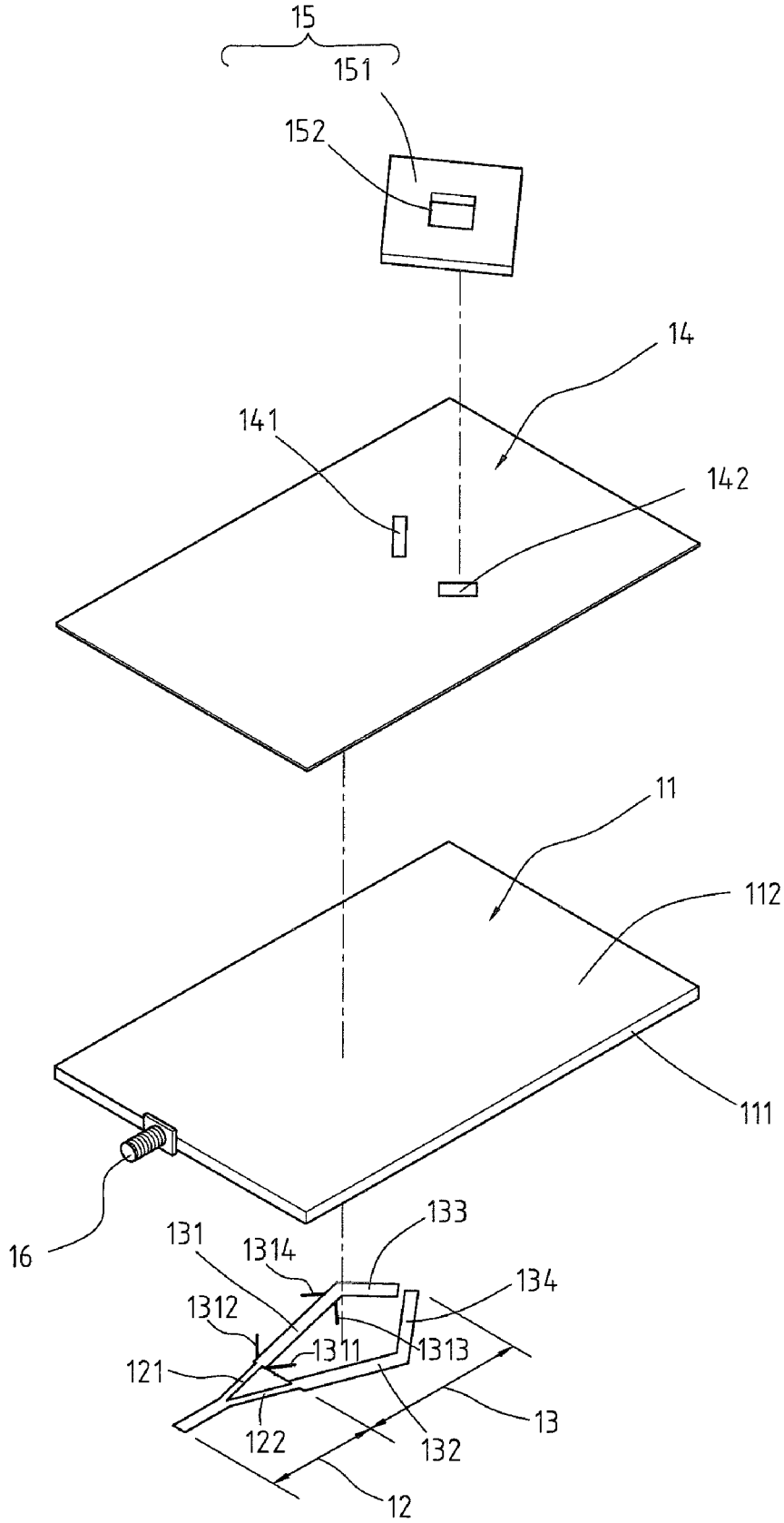
FIG. 2 is a schematic exploded view of the circularly-polarized DRA of the present invention.

Referring to FIGS. 1 and 2, a perspective and a schematic exploded view of the circularly-polarized dielectric resonator antenna of the present invention are respectively illustrated.

The circularly-polarized DRA 1 comprises: a substrate 11 including a first surface 111 and a second surface 112, which is a printed circuit board made of a material having a dielectric constant of 2-13, for example, an FR4 substrate with the dielectric constant of 4.4; a Wilkinson power divider 12 formed on the first surface 111 and having an input port and two output ports 121 and 122, in which the Wilkinson power divider 12 can generate two signals with the same magnitude and a phase difference of 90°; a phase shifter 13 formed on the first surface 111 and connected to the Wilkinson power divider 12, and having a main microstrip line 131, a reference microstrip line 132, a first microstrip line 133, and a second microstrip line 134, in which input ports of the main microstrip line 131 and the reference microstrip line 132 are respectively connected to the two output ports 121 and 122 of the Wilkinson power divider 12, and the first microstrip line 133 and the second microstrip line 134 are respectively connected to output ports of the main microstrip line 131 and the reference microstrip line 132, in which an open-circuited microstrip line 1311 with a quarter wavelength and a short-circuited microstrip line 1312 with a quarter wavelength are connected in parallel at the input port of the main microstrip line 131, an open-circuited microstrip line 1313 with a quarter wavelength and a short-circuited microstrip line 1314 with a quarter wavelength are connected in parallel at the output port, and the short-circuited portions are connected to a ground plane 14 through two vias; a ground plane 14 formed on the second surface 112, which can be a metal layer, in which the ground plane 14 further includes a first hollow portion 141 and a second hollow portion 142 that are long-rectangular shaped, and axis lines of the first hollow portion 141 and the second hollow portion 142 are orthogonal; and a dielectric resonator 15 disposed above the ground plane 14 and including a dielectric main body 151 and a well 152, in which the dielectric main body 151 is a square or rectangular structure, the dielectric main body 151 is overlapped above the first hollow portion 141 and the second hollow portion 142 of the ground plane 14, and the well 152 has an annular rectangle shape embedded in the main body 151.

The circularly-polarized DRA 1 further includes a signal input/output device 16 disposed on a side edge of the substrate 11, for inputting and outputting signals. The first microstrip line 133 and the second microstrip line 134 of the phase shifter 13 must be disposed to respectively extend to pass through the centers of the first hollow portion 141 and the second hollow portion 142. Next, the material of the dielectric resonator 15 has the characteristics of high dielectric constant and low loss, the range of dielectric constant is between 10 and 100, the loss tangent is usually smaller than 0.005, so as to have the feature of high radiation efficiency. When electric line passes through the well 152, the dielectric constant of the dielectric resonator 15 is greater than the dielectric constant of air ($\in\gamma=1$), such that the electric field is enhanced by several times, the more efficient the electromagnetic wave radiation, the lower the quality factor Q, consequently the bandwidth of the signal transmission is increased.

In addition, the design of the width of the microstrip line of the Wilkinson power divider 12 and the selection of bridged resistance make the fed signal to have no reflection when the two output ends of the Wilkinson power divider 12 match with their respective load. The design of the width and the length of the microstrip line of the phase shifter makes the main microstrip line and the reference microstrip line to have a phase difference of 90°, the same amplitude, and a minimum return loss at the operating frequency.

Sizes of different parts of the DRA 1 are given as follows. The main body 151 includes a length a, a width b, and a height d. A width of the well 152 is s, and the substrate 11 and the ground plane 14 respectively have a length $W_x$ and a width $W_y$. The phase shifter 13 has a width $W_m$ and is joined with the Wilkinson power divider 12. The first microstrip line 133 and the second microstrip line 134 of the phase shifter 13 respectively extend to exceed the first hollow portion 141 and the second hollow portion 142 by a length $L_s$, and the first hollow portion 141 and the second hollow portion 142 all have a length $L_a$ and a width $W_a$.

In addition, it should be noted that some performance indices of the DRA 1 provided by the present invention can be controlled by adjusting related elements. For example, (1) the position of the dielectric resonator 15 is fine-adjusted to match the input impedance with the input signal line, (2) the size of the main body 151 is adjusted to adjust the radiation frequency of the antenna, and (3) the width of the well 152 is adjusted to fine-tune the resonance frequency of the antenna and to increase the radiation bandwidth.

Next, one of the preferred embodiments of the present invention is disclosed as follows, in which size parameters of the main body 151 and the well 152 of the dielectric resonator are defined to be a=22 mm, b=22 mm, d=4 mm, s=6 mm.

The first hollow portion 141 and the second hollow portion 142 respectively have a length $W_a$ and a width $L_a$, wherein $W_a$=1 mm and $L_a$=9 mm, and the substrate 11 and the ground plane 14 respectively have a length $W_x$, a width $W_y$ and a thickness t, wherein $W_x$=80 mm, $W_y$=55 mm, and t=1.6 mm, the dielectric constant is 4.4, and the dielectric constant $\in\gamma$ of the dielectric resonator 15 is 20.

Subsequently, the length and width of the output end of the Wilkinson power divider are respectively 9.5 mm and 3 mm, and in the phase shifter 13, the length and width of the main microstrip line are respectively 20 mm and 2.3 mm, the length and width of the reference microstrip line are respectively 27 mm and 3 mm, the length and width of the first microstrip line are respectively 11 mm and 2.3 mm, and the length and width of the second microstrip line are respectively 13.5 mm and 3 mm. Further, the length of the first microstrip line 133 and the second microstrip line 134 exceeding the first hollow portion 141 and the second hollow portion 142 by $L_s$ which is 3 mm.

Figure 3:
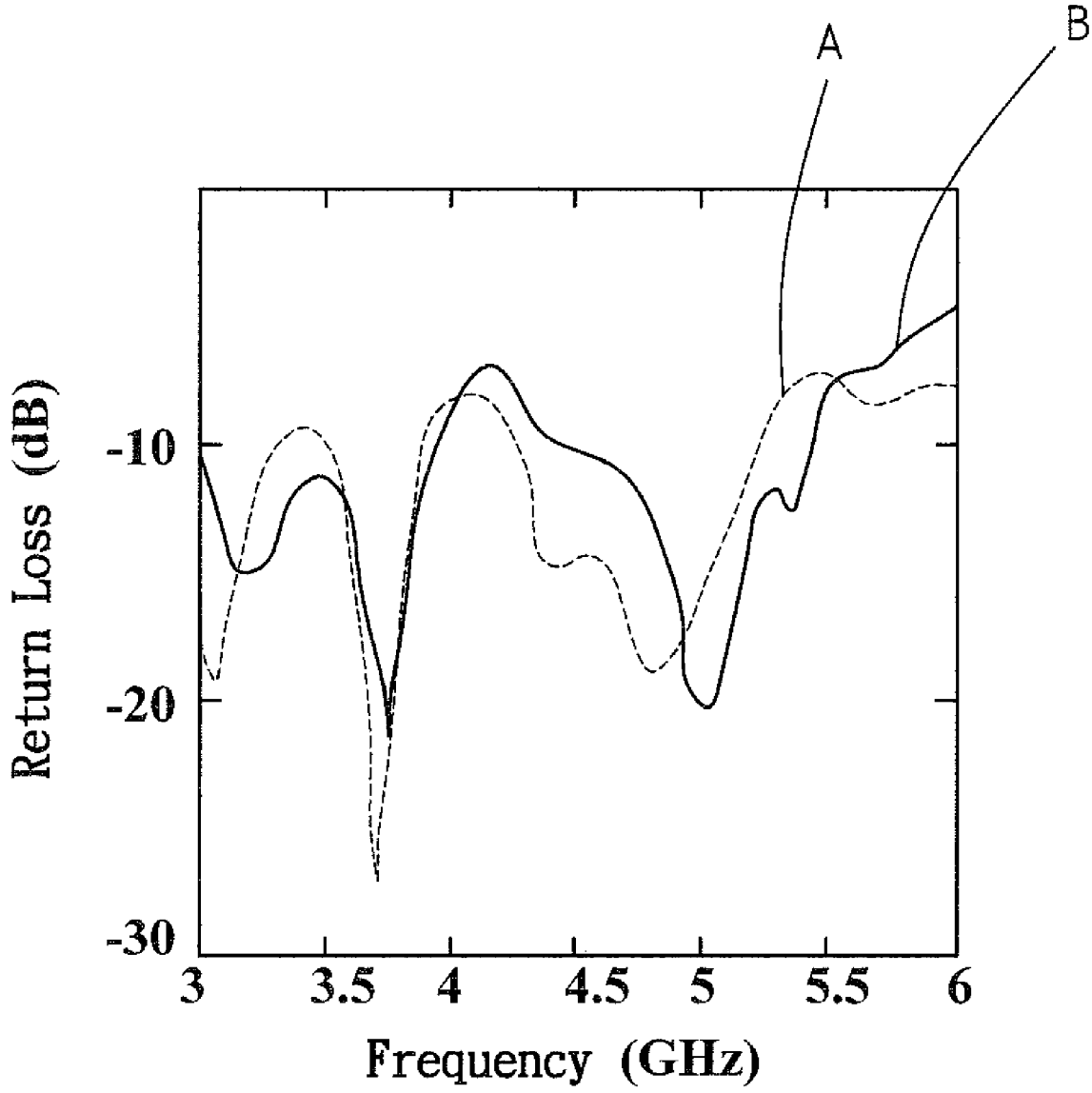
FIG. 3 is a diagram illustrating return loss of the signal radiation of the circularly-polarized DRA according to the embodiment of the present invention.

FIG. 3 is a diagram of return loss of the signal radiation of the embodiment, showing the simulation result and practical measurement of the return loss of the signal radiation, in which dashed line represents a result of simulated return loss A of the signal radiation, and solid line represents a result of practically measured return loss B of the signal radiation. When the return loss is lower than 10 dB, the signal radiation band is between 4.43 GHz and 5.85 GHz.

Figure 4:
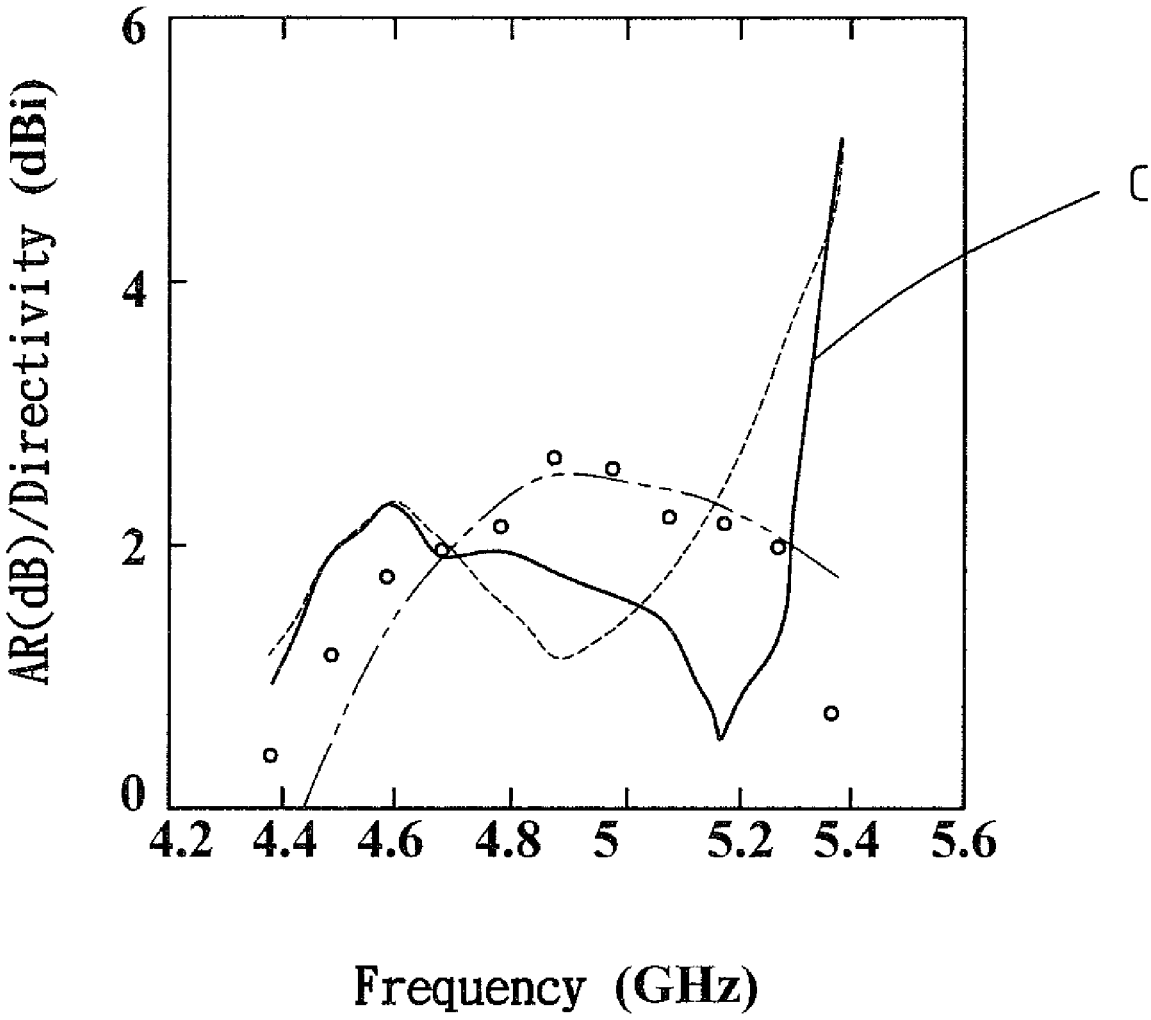
FIG. 4 is a diagram of directivity and AR of the antenna radiation of the circularly-polarized DRA according to the embodiment of the present invention.

Next, referring to FIG. 4, illustrating a radiation performance diagram of the antenna according to the embodiment of the present invention, in which the solid line represents the result of practically measured AR, the dashed line represents the result of simulated AR, and broken line and circled line are respectively measured and simulated antenna directivity. It can be observed from the drawing that when the AR is smaller than or equal to 3.5 dB and the return loss is lower than −10 dB, the frequencies range is between 4.4 GHz and 5.3 GHz, over which the directivity is between 1.8 dBi and 4 dBi.

Figure 5A:
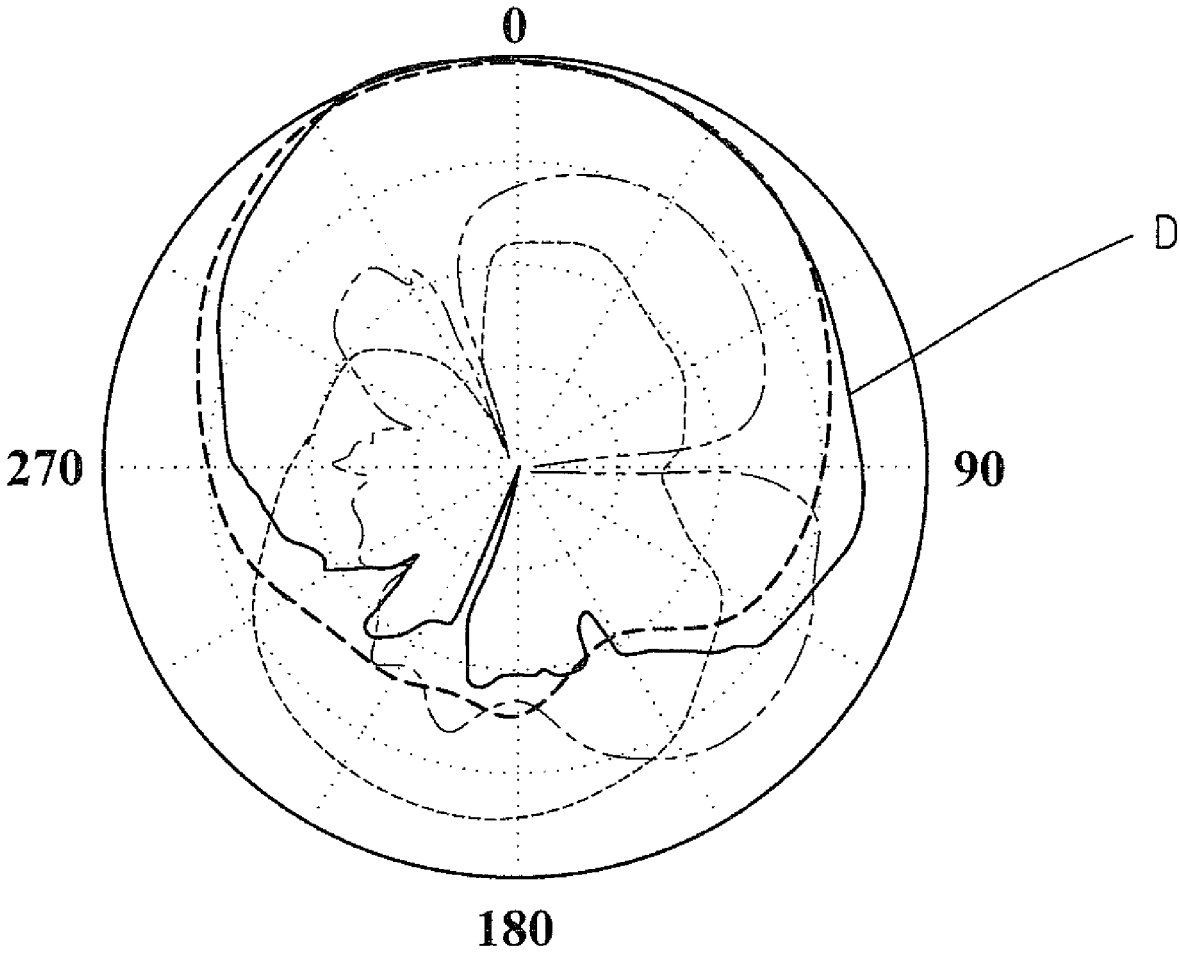
FIGS. 5A to 5C are radiation pattern diagrams of the circularly-polarized DRA according to the embodiment of the present invention.
Figure 5B:
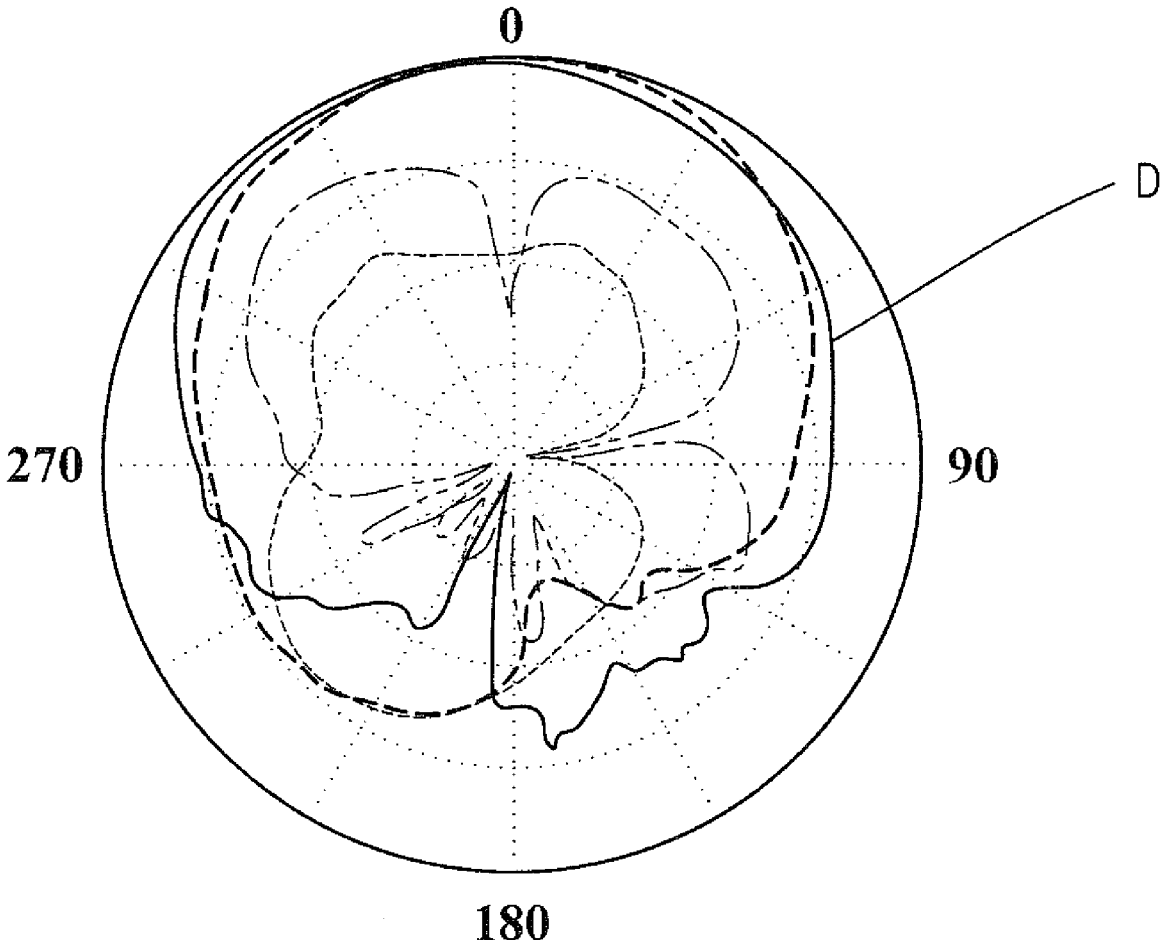
Figure 5C:
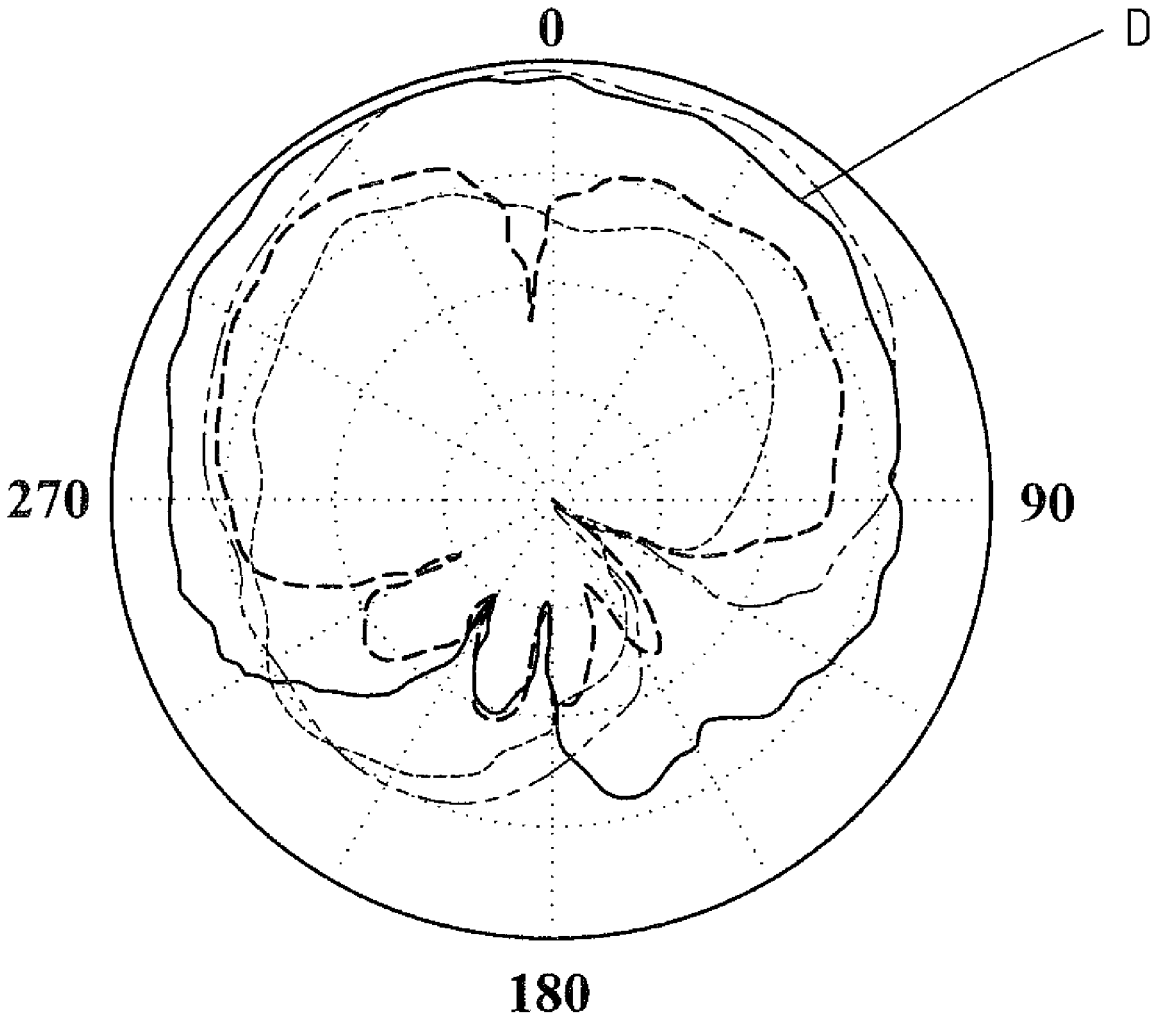

Referring to FIGS. 5A to 5C, radiation pattern diagrams of the embodiment of the present invention are shown. FIGS. 5A to 5C sequentially represent radiation patterns of the embodiment of the present invention in the x-y plane at frequencies of 4.45 GHz, 4.9 GHz, and 5.2 GHz, respectively, in which the solid line is the measurement of the left-hand circular polarization (LHCP) D, and the dashed line is the measurement of the right-hand circular polarization (RHCP) at the frequency of 4.9 GHz, a broadside radiation of LHCP is observed, and the 3 dB AR beamwidth is about 25°(−10°□ϕ□−15°). The antenna gain of LHCP is about 3.8 dBi. The front-to-back ratio is more than 12 dB.

While the invention has been particularly shown and described with reference to the preferred embodiments thereof, these are merely examples to help clarify the invention and are not intended to limit the invention. It will be understood by those skilled in the art that various changes, modifications, and alterations in form and details may be made therein without departing from the spirit and scope of the invention, as set forth in the following claims.

What is claimed is:

1. A circularly-polarized dielectric resonator antenna (DRA), comprising:

a substrate, including a first surface and a second surface;

a Wilkinson power divider, formed on the first surface;

a phase shifter, formed on the first surface and having a main microstrip line, a reference microstrip line, a first microstrip line, and a second microstrip line, wherein the main microstrip line and the reference microstrip line are respectively connected to two output ports of the Wilkinson power divider, and the first microstrip line and the second microstrip line are respectively connected to the main line and the reference line;

a ground plane, formed on the second surface and comprising a first hollow portion and a second hollow portion; and a dielectric resonator, including a main body and a well, disposed above the ground plane.

2. The circularly-polarized DRA as claimed in claim 1, wherein the antenna further comprises a signal input/output device disposed on a side edge of the substrate.

3. The circularly-polarized DRA as claimed in claim 1, wherein the dielectric resonator is disposed above the first hollow portion and the second hollow portion.

4. The circularly-polarized DRA as claimed in claim 1, wherein the main body of the dielectric resonator is a square or rectangular structure.

5. The circularly-polarized DRA as claimed in claim 1, wherein the well of the dielectric resonator is an annular rectangular shape.

6. The circularly-polarized DRA as claimed in claim 1, wherein the dielectric constant of the dielectric resonator is between 10 and 100.

7. The circularly-polarized DRA as claimed in claim 1, wherein the first microstrip line and the second microstrip line are respectively extended to pass through centers of the first hollow portion and the second hollow portion.

8. The circularly-polarized DRA as claimed in claim 1, wherein the axis lines of the first hollow portion and the second hollow portion are orthogonal.

9. The circularly-polarized DRA as claimed in claim 1, wherein the signal radiation band having a low return loss of lower than 10 dB is between 4.43 GHz and 5.85 GHz.

* * * * *